United States Patent [19]

Tarumi et al.

[11] 4,439,462

[45] Mar. 27, 1984

[54] METHOD FOR TRANSFERRING AND FIXING A TONER IMAGE

[75] Inventors: Noriyoshi Tarumi; Kiyoshi Kimura; Hiroshi Tokunaga; Yukio Okamoto; Makoto Tomono, all of Hachioji, Japan

[73] Assignee: Konishiroku Photo Industry Co., Ltd., Tokyo, Japan

[21] Appl. No.: 361,540

[22] Filed: Mar. 24, 1982

[30] Foreign Application Priority Data

Apr. 3, 1981 [JP] Japan ..... 56-49298

[51] Int. Cl.[3] ..... G03G 13/16

[52] U.S. Cl. ..... 427/14.1; 430/98; 430/99; 430/126; 118/101

[58] Field of Search ..... 430/98, 99, 126; 427/14.1

[56] References Cited

U.S. PATENT DOCUMENTS 4,095,886 6/1976 Koeleman et al. ..... 430/126 X

*Primary Examiner*—John D. Welsh

*Attorney, Agent, or Firm*—Jordan B. Bierman; Linda Bierman; C. Cornell Remsen, Jr.

[57] ABSTRACT

In the transfer of a toner image from a transfer medium such as a belt to transfer material such as paper, heating and fixing of the toner is required. According to the present invention, two sources of heat are used, one applied to the transfer medium and the other to the paper, the heat applied to the transfer medium being insufficient to melt or fuse the toner, with the heat applied to the paper being greater than necessary for fusing. When the hot paper contacts the underheated transfer medium the temperature of the latter is then and only then increased to the fusing temperature and the transfer and fixing of the toner image upon the paper takes place.

4 Claims, 8 Drawing Figures

METHOD FOR TRANSFERRING AND FIXING A TONER IMAGE

BACKGROUND OF THE INVENTION

1. Field of the Invention

The present invention relates to a method for transferring and fixing a toner image, and more particularly to a method for transferring and fixing a toner image in which an intermediate transfer medium is utilized.

2. Description of the Prior Art

Commonly, in an image forming means having been provided with an intermediate transfer medium, a toner image held on a toner image carrier is formed through the development of an electrostatic latent image thereof by a developing toner, and is then transferred onto an intermediate transfer medium in the form of an endless belt or a roll, and the toner image thus transferred onto the intermediate transfer medium is further transferred again onto and then fixed on transfer material such as a transfer paper, and thus, an image is formed. According to such a means, it is possible to obtain a final image of high quality and additionally to introduce a so-called retention system, that is, a system in which a latent image once formed is utilized several times by repeating the development and the transferring thereof to form a great number of the identical final-images; this also results in the advantage that it is capable of providing high speed image formation. In addition to the above, it has also the other advantage of simplifying the development system, and of improving the image quality, and the like, because of the fact that an image transfer can be made onto a transfer material comprising a plain paper even when using a one-component conductive toner to serve as the developing toner. The various conditions required are very severe to properly accomplish the transfer of a toner image on the intermediate transfer medium onto the transfer material, and at the same time to accomplish the fixation thereof, and therefore it is quite difficult to accomplish the transfer and the fixation of an excellent toner image.

Heretofore, as has been described in Japanese Patent Examined Publication No. 41679/1971, for example, the means has been already known in which a toner image is transferred and fixed by the heat radiated from the transfer material that is heated, without heating the toner image on an intermediate transfer medium.

The aforesaid means is poor in thermal efficiency, so that it necessitates giving a considerably great amount of thermal energy to the transfer material, while it is advantageous in the aspects that there is no danger of overheating the intermediate transfer medium and it is capable of preventing the toner image carrier from causing a bad thermal influence. Besides, the amount of the thermal energy to be given to said transfer material varies in accordance with the kind of transfer material, that is, for example, a transfer material comprising a relatively heavier weight paper or a porous paper necessitates a great amount of thermal energy, and if the amount of thermal energy equivalent thereto is applied to a transfer material comprising a relatively higher weight paper or thinner one in thickness, it results in an overheated state and the transfer material is deformed, or a burn occurs. It is therefore necessary to control the thermal energy supply according to the kind of transfer materials so as to achieve an excellent transfer and fixing. Furthermore in the case that the toner image transfer and the fixation thereof are made at a high speed, it necessitates a further greater amount of thermal energy supply to the transfer material, with the result that the energy consumption is increased and there is a great danger of an outbreak of fire if a transfer material jamming was taken place.

On the other hand, as has been described in Japanese Patent Open to Public Inspection No. 78559/1974, there has been known the means in which a toner image on an intermediate transfer medium are heated up to the fusing temperature thereof without heating a transfer material, and thereby said toner image on the intermediate transfer medium is transferred onto and fixed on the transfer material.

In the aforesaid means, however, it becomes difficult to perform the fixing securely, because of the fact that the fluidity of the toner on the side coming into contact with the transfer material is worsened by collection of a large amount of heat radiated from the toner to the transfer material, and it is therefore necessary in practice to also properly heat up the intermediate transfer medium. Accordingly, heat is applied to the toner image carrier through the intermediate transfer medium, and in the case that the toner image carrier is an electrophotographic sensitive element, there occurs a decrease in image density caused by the lowering of initial potential, and a fog caused by the adhering of the material components of the intermediate transfer medium onto the surface of the toner image carrier, and it is impossible to obtain greater durability because the worsening of the intermediate transfer medium comes more quickly.

In order to avoid such troubles as described above, ways may be taken to cool the intermediate transfer medium in the moving passage area after the transfer and the fixing thereof, however, in the case of a forced cooling, a greater amount of energy is further consumed, and in the case of a spontaneous cooling, it is necessary to lengthen the moving passage to reach the toner image carrier, so that the equipment becomes larger in size.

In the processes of the transfer and the fixing of the toner, as already described, the toner on the side coming into contact with a transfer material is antecedently cooled and the fluidity thereof is worsened, and therefore, the cooled toner is not transferred completely to the transfer material and partially remain on the intermediate transfer medium as it is adhered thereto, so that the toner image carrier is contaminated and an offset phenomenon is also occurs.

SUMMARY OF THE INVENTION

The present invention results from on the circumstances described above.

It is an object of present invention to provide a method for transferring and fixing a toner image, which is capable of transferring and fixing a toner image on a toner image carrier securely onto a transfer material by utilizing an intermediate transfer medium which is also capable of obtaining a high quality image in which less energy is less consumed and furthermore a high resolution results thanks to the retention system.

It is an another object of present invention to provide a toner image transferring and fixing means which is capable of performing the aforesaid method and whose structure is compact.

It is still another object of present invention to provide a toner image transferring and fixing means which is capable of producing no offset phenomenon and is also capable of widening the range selectable for a toner components.

The abovementioned objects can be achieved by a toner image transferring and fixing method, which comprises transferring a toner image on a toner image carrier onto an intermediate transfer medium by bringing the former into pressure contact with the latter, heating said intermediate transfer medium and said toner image carried thereon at a temperature lower than fusing temperature of said toner and transferring and fixing a heated toner image on the intermediate transfer medium onto a transfer material by bringing the former into contact with the latter in the state where said transfer material is being heated.

DETAILED DESCRIPTION OF THE PREFERRED EMBODIMENTS

Figure 1:
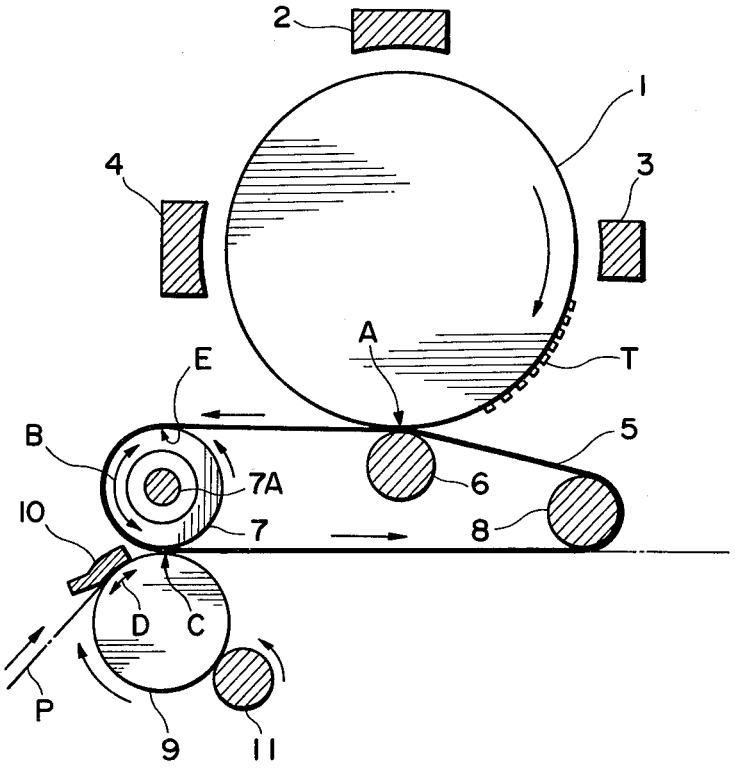
FIG. 1 is an illustrative diagram of the constitution of the overall equipment in one of the examples of the present invention.

FIG. 1 is an illustrative diagram of one of the examples of the present invention. In this example, in the area along the outer circumferential surface of a rotary drum type toner image carrier 1, there are arranged in the revolving direction an electrostatic latent image forming means 2, a developing means 3, and a cleaning means 4 in the order arranged as above, and in transferring area A between said developing means 3 and said cleaning means 4, intermediate transfer medium 5 comprising an endless belt is pressed against the outer circumferential surface of the toner image carrier 1 by a pressure roller 6. Said intermediate transfer medium 5 which is suspended above a heat roller 7, a tension roller 8 and the pressure roller 6, and in said transferring area A it is moved at a uniform velocity in the same direction with the moving direction of toner image carrier 1 and in the direction of intermediate transfer medium heating area B located on heat roller 7.

In the transferring and fixing area at the disengaging point of said intermediate transfer medium 5 from the heat roller 7 or the neighborhood thereof, there is provided a pressure contact roller 9 which is pressed against said heat roller 7, and a transfer material heating plate 10 is arranged along transfer material heating area D which is located immediately before said transferring and fixing area C in the direction of transfer material moving passage P, said passage P being so provided as to pass through said transferring and fixing area C.

By making use of such a means as described above, in the present invention, a toner image having been formed on the toner image carrier is ultimately transferred and fixed onto a transfer material in the following steps:

Firstly, a toner image T on the toner image carrier 1 is formed by means of the developing means 3 which develops an electrostatic latent image having been formed by latent image forming means 2. In other words, when utilizing an electrophotographic method, toner image carrier 1 comprises an electrophotosensitive element of selenium, organic compounds, binder types of zinc oxide or a cadmium sulfide, or other electrophotosensitive elements, and the outer circumferential surface of said toner image carrier 1 is wholly charged by the latent image forming means 2, and then an electrostatic latent image is formed by an image exposure. In the case of utilizing an electrostatically recording method, toner image carrier 1 comprises a dielectric material comprising an electrically conductive substrate and a dielectric layer, and an image signal is converted into the electrostatic latent image by means of a multi-stylus electrode or an ion modulating electrode, and thereby a latent image is formed. In in the case of utilizing a magnetically recording method, it may be that toner image carrier 1 comprises a magnetic substance and an image signal is converted into the magnetic signal by means of a magnetized head and thereby a magnetically latent image is thus formed.

A latent image thus formed in any such a manner as described above is made visible with a toner having been charged at the polarity opposite to the charge forming the latent image, by means of developing means 3. If the toner used therein is a one-component conductive magnetic toner, this is developed by the charge induced from the toner. In the case of utilizing a magnetic brush method in which one-component conductive magnetic toner is used, it is particularly preferable in the respect that, because the toner layer is formed as a single layer of toner grains or a thin layer closely allied thereto, the results are excellent in the quality, durability, and high speed developability of an image that is ultimately obtainable, and because it is also capable of transferring the images excellently without necessarily selecting a suitable transfer material. In the case in which the image is a magnetically latent image, the development thereof utilizes a magnetic toner, and a sharp and clear image can be obtained because of the fact that an image is prevented from blurring while it is being transferred.

Toner image T having thus been formed on toner image carrier 1, is transferred onto an intermediate transfer medium 5 in transfer area A with the pressure force of pressure roller 6.

Said intermediate transfer medium 5 is formed of a layer element laminated thereon with a transfer layer comprising a heat resisting elastic substance such as silicone rubber or a fluorine-containing rubber, with a heat resisting substrate such as a stainless steel plate, or also a heat resisting macromolecular film such as a heat resisting film (e.g., "U-sheet" mfd, by Taihei Chemical Co., Japan) of which the material is polyimide, polyimideamide, polyamide, polyester, polyallylate or the like; the material of such transfer layer is preferably of the room temperature vulcanizing type or of a low temperature vulcanizing type of silicone rubber, in particular. For example, "LTV 1300" and "LTV 1800" (both mfd. by Shin-etsu Chemical Industrial Co., Japan) are additional polymerizing types of silicone rubber which are materials particularly preferable for a transfer layer. Said silicone rubber layer is capable of capturing a sufficient quantity of toner onto the side of the intermediate transfer medium in transferring area A with a force sufficiently overcoming the toner carrying force of toner image carrier 1 because of the suitable adhesiveness of the surface thereof, and the elasticity of the rubber is capable of embracing the toner, at a low temperature. On the other hand, the surface energy thereof is sufficiently lower than that of the ordinary transfer materials, therefore, in transferring and fixing area C on which will be described hereinafter, when the transfer material is brought into pressure contact with the aforesaid toner in the state where said toner is heated by the surface of the toner transfer material side and is fluidized, said toner adheres firmly to the transfer material and then is almost completely transferred and fixed to the transfer material. From the view point of the fact that it is preferable that toner image T and intermediate transfer medium 5 are to be heated at a high speed by means of heat roller 7, it is preferable that the thickness of the transfer layer and the substrate are preferably thinner than the normal range, for example, a thicknesses of the transfer layer of 10–500 microns and of the substrate of 10–500 microns being most suitable.

As for the intermediate transfer media, they are not limited to an endless belt, but it will also do to use, for example, a transfer layer provided on the surface of a hollow roller made of aluminium or stainless steel, with a heater being further provided inside the said roller.

Heat roller 7 is preferably a hollow roller of metal such as aluminium inside which heater 7A comprising an infrared lamp for example, is built-in, and in which the temperature of the said metal roller surface is controlled to a suitable degree, and thereby intermediate transfer medium 5 comprising an endless belt and toner image T thereon are heated up to the temperature lower than the fusing temperature of the aforesaid toner in intermediate transfer medium heating area B, that is, the area between contact starting point E and fixing area C.

The temperature of intermediate transfer medium 5 in this case is preferably as low as possible provided that the transfer and fixing steps are satisfactorily performed onto a transfer material, in transferring and fixing area C. The reason thereof is that, if the temperature of intermediate transfer medium 5 should be raised, toner image carrier 1 is heated up by the heat radiated from said intermediate transfer medium 5 in transferring area A, so that the performance of toner image carrier 1 that should perform at a low temperature is lowered, and at the same time that an image quality degradation is caused by the transition of the material components of the toner or intermediate transfer medium 5 onto toner image carrier 1. Accordingly, it becomes necessary to effect a forcible cooling before transferring area A, if the temperature of intermediate transfer medium 5 is raised.

As for pressure contact roller 9 to be used in transferring and fixing area C, a heat resisting elastic roller is preferably provided, with the surface made of silicone rubber or the like. A transfer material heating plate 10 as illustrated has a form suitable for coming into contact along with the outer circumferential surface of the pressure contact roller 9, and thereby the aforesaid transfer material is heated up to the temperature to some extent higher than the fusing temperature of said toner at the time when said transfer material is passed through the space between the surface of the pressure contact roller 9 and the transfer material heating plate 10; thus, the toner image on intermediate transfer medium 5 is satisfactorily transferred and fixed to said transfer material in the transferring and fixing area C. In this case, the coefficient of friction of the surface of the pressure contact roller 9 is made greater than that of the surface of the transfer material heating plate 10, and accordingly, the transfer material is slidingly moved on and then is brought into heated contact with the surface of fixed transfer material heating plate 10 with the movement of the surface of the rotating pressure contact roller 9, and is thus conveyed into transferring and fixing area C. The transfer material thus heated in this manner is then interposed between and brought into pressure contact with both intermediate transfer medium 5 having been heated together with the toner image in advance by means of heat roller 7, and pressure contact roller 9, and thereby the toner of the toner image at least on the side coming into contact with the transfer material are fused by the heat radiated from the transfer material or said toners are further brought into contact with the transfer material as in this state, and therefore they are securely transferred and fixed onto the transferred material.

It is most preferable to heat up said transfer material heating plate 10 coming into contact with the transfer material surface, as shown in the example illustrated in the drawing, and in this case, it is essential that the coefficients of friction of both transfer material heating plate 10 and the transfer material should be small, and on account thereof it is effective to make the surface of transfer material heating plate 10 smooth or to coat thereon with a material having a small coefficient of friction such as a fluorine-containing resin. For example, it is particularly effective, from the view points of anti-abrasion strength and the small coefficient of friction thereof, to coat with a resin such as polytetrafluoroethylene, parfluoroalcoxy resin, polyfluoroethylene or propylene onto a substrate such as aluminium or stainless steel, or to coat "Rulon" (mfd. by Dixon Co.), for example, that is prepared by mixedly dispersing metallic powders, an inorganic oxide or the like into such a resin as given above, or to apply a Teflon impregnating Tufram process to a hard Alumite processed porous substrate. Such a heating plate processed with a coating or Tufram has low surface energy, so that there is no accumulation of stains such as toner, so that it is excellent also in this respect. Furthermore, a metal plate having a hard chrome-plated mirror surface is also a preferable material. A heater containing plate preferably serves as the heater for the transfer material heating plate 10, and a PTC plate comprising a resistance type heating element having positive temperature characteristics need not control the temperature and is advantageous from the view point of the economy of electric power.

It is preferable to bring the transfer material heating plate 10 into contact with the transfer material as described above, and it is also premissible to bring it only partially into contact with the surface of a transfer material. If in such a condition that it is brought very closely into contact therewith, it is possible to obtain a satisfactory heating effect without necessarily bringing it into direct contact therewith. In this case, the parting distance between the heating plate and the surface of a transfer material is normally not less than 3 mm. Or again, it is also effective to heat up the transfer material by arranging a pinch roller system in which a heat roller is used in a position before transferring and fixing area C.

The transfer material having passed through transferring and fixing area C is usually conveyed along intermediate transfer medium 5 and is then separated from said intermediate transfer medium 5 by a tension roller 8. Therein, such separation of the transfer material from the intermediate transfer medium 5 can easily be made if the diameter of tension roller 8 is made small, and in addition thereto, if said tension roller 8 is swung, it is possible to prevent intermediate transfer medium 5 from being displaced.

Intermediate transfer medium 5 having passed through transferring and fixing area C is naturally cooled, and it is capable of again receiving a transfer in transferring area A; the successive transferring and fixing processes are further repeated in transferring and fixing area C.

In the drawings, numeral 11 designates a cleaning roller which removes toner when it adheres to pressure contact roller 9.

In the present invention, as described above, the toner of a toner image which has been transferred from toner image carrier 1 onto intermediate transfer medium 5, is heated up together with the intermediate transfer medium 5 supporting the toner to the temperature lower than a fusing temperature of the toner, and on the other hand, said intermediate transfer medium 5 is heated up to a necessary and sufficient temperature, and then, keeping the conditions as they are, intermediate transfer medium 5 and a transfer material are themselves brought into pressure contact with each other, so that the toner can be transferred and fixed onto the transfer material without disturbing the toner image.

In other words, in intermediate transfer medium heating area B, the toner image is heated up only to such temperature as will maintain the condition that either the toner is not fused but remains solid, or the condition that it is deformed under pressure; therefore, the toner image which is to reach the transferring and fixing area C still remains in the same condition as it has been transferred from toner image carrier 1, and there is no disturbance of the image caused by the toner thereof partaking of fluidity, and also this toner in the condition is brought into pressure contact with the transfer material in transferring and fixing area C. Accordingly, the temperature of the toner is raised from the side thereof coming into contact with a transfer material by the heat radiated from the transfer material, and thus the portion of the toner having been heated is fused or deformed under contact pressure and adheres to the transfer material, so that the toner is transferred and fixed without destroying the toner and without causing any blur, and accordingly maintaining a high resolving power. Additionally, an offset phenomenon is rarely caused in the extreme case, because the toner still remains unchanged in the solid state or in a highly viscous state. Because of heating up the three, the intermediate transfer medium 5, the toner and the transfer material, altogether, it becomes possible to lower the heating temperature to be necessary for each of the above three, and therefore it also becomes unnecessary to heat up excessively each of the three, and it further becomes possible to restrain the radiating amount of heat to make it small and in addition, it is still further possible to greatly improve the whole thermal efficiency, so that the whole amount of energy consumption can greatly be economized. Again, it becomes possible to perform a toner image transfer and the fixing thereof at a high speed rate.

As has been described above, the temperature of intermediate transfer medium 5 having passed through transferring and fixing area C can particularly be held lower and the natural radiation of heat is enough to cool intermediate transfer medium 5 without cooling forcibly. Even if toner image carrier 1 has a heat sensitive property, like a photoconductive light-sensitive element, the excellent properties thereof are not disturbed, or an inconvenience such as the adhesion of a part of the material components of intermediate transfer medium 5 to toner image carrier 1 can be prevented, it is also possible to maintain the durability thereof for a long period of time because of the fact that the intermediate transfer medium 5 is not heated up to a high temperature and that it is not subjected to a radical temperature change. Economy of costs can thus be realized because of the fact that the heat resistance conditions necessary for the materials of the intermediate transfer medium 5 are relaxed and that the scope selectable for the materials is broadened.

When the fixing of the toner is performed as described above, the separation of the toner image is almost perfectly made from the intermediate transfer medium 5 in transferring and fixing area C, and consequently, no toner remains on intermediate transfer medium 5 after it is transferred and fixed, so that it prevents the toner image carrier 1 from staining and an offset phenomenon from occurring.

In the present invention, it is not forbidden to forcibly cool the intermediate transfer medium 5 or the toner image carrier 1 if desired.

Figure 2:
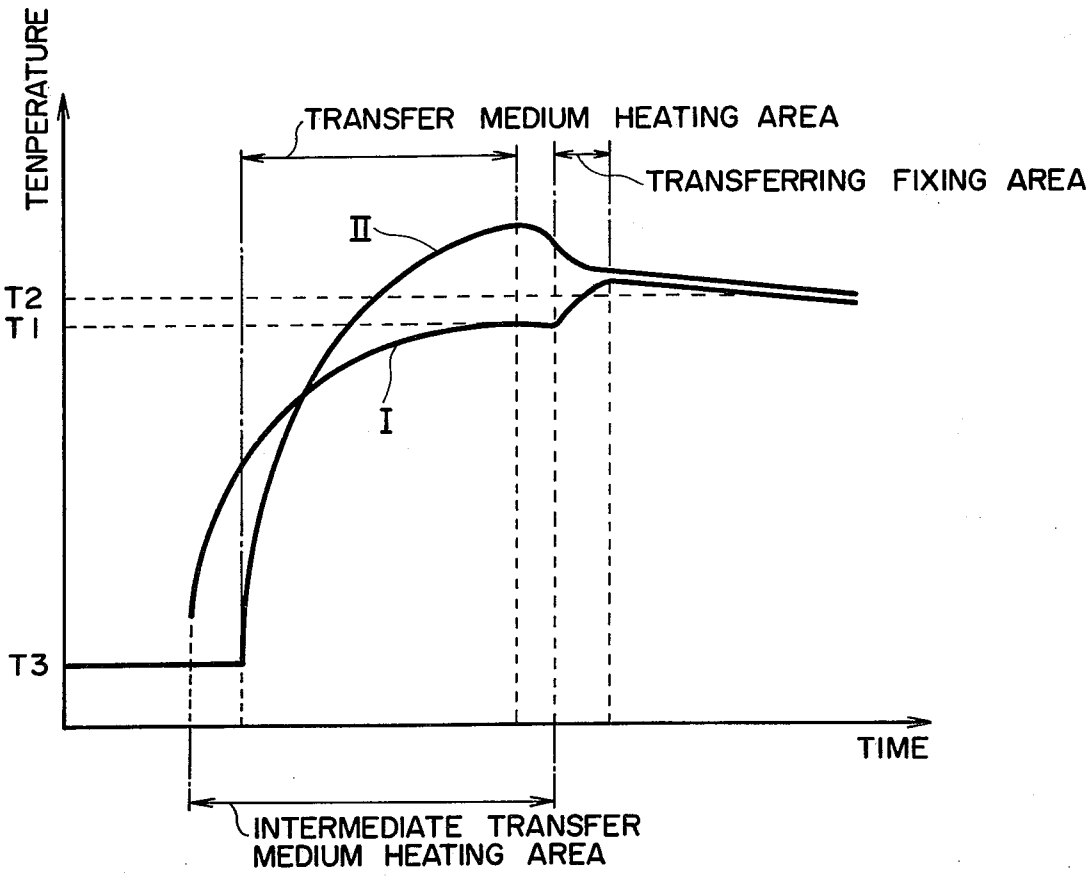
FIG. 2 is a graph of the curves indicating the temperature changes both of an intermediate transfer medium carrying a toner image, and of the transfer material in the example shown in FIG. 1.

FIG. 2 shows the temperature changes of both the intermediate transfer medium 5 holding a toner image, and the transfer material in one of the examples of the means constituted as illustrated in FIG. 1. Curve I shows the temperature changes both of a toner image and the surface of intermediate transfer medium 5 holding the toner image, and curve II shows the temperature changes on the surface of a transfer material with which intermediate transfer medium 5 is brought into contact. Character T1 represents the given temperature of heat roller 7, T2 represents the minimum temperature enabling a toner image to be transferred and fixed, and T3 represents the room temperature, respectively. As is obvious from the curves I and II, the surface temperatures of the toner image on intermediate transfer medium 5 immediately before entering transferring and fixing area C and that of intermediate transfer medium 5, are lower than minimum temperature T2 enabling a toner image to be transferred and fixed, so that the toners are still in the non-fluid condition or in the solid condition, and on the other hand, the temperature of the transfer material in that moment is higher than the minimum temperature T2 enabling the toner image to be transferred and fixed, and in the next transferring and fixing area the surface temperature of the toners with which the transfer material is brought into contact is raised higher, by the heat radiated from the transfer material, than the minimum temperature T2 enabling the toner image to be transferred and fixed, and thus, a satisfactory transfer and fixation may be attained. In such a case, minimum temperature T2 enabling a toner image to be transferred and fixed is not always the fusing temperature of a toner but sometimes it also means the temperature that toners are sufficiently deformed under pressure.

In the present invention, intermediate transfer medium comprising an endless belt and toner are both heated by the conductive heat from heat roller 7 coming into contact with intermediate transfer medium to serve also for suspensively supporting said intermediate transfer medium 5 as illustrated in the example of the drawings, that is desirable from the viewpoint of the thermal efficiency thereof. In this case, it is also desirable to bring the intermediate transfer medium 5 into heated contact with said heat roller 7 in intermediate transfer medium heating area B over a central angle of 90° or wider. Because of such a sufficiently wide area of intermediate transfer medium heating area B, it is possible to maintain the state in which the temperatures of both intermediate transfer medium 5 and heat roller 7 become approximately equal to each other, and also to control the temperature of the toner on the intermediate transfer medium 5 very accurately immediately before entering transferring and fixing area C, and further to perform a stable transfer and fixation of the toner, and still further, in addition, to miniaturize the size by making the diameter of heat roller 7 smaller.

Figure 3:
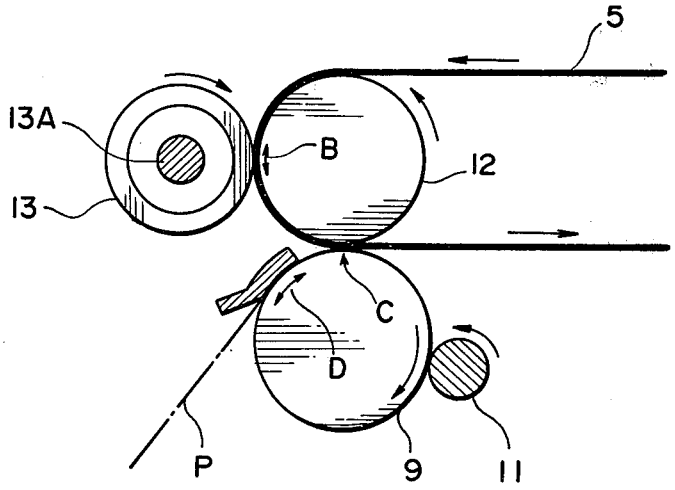
FIG. 3 is an enlarged illustrative diagram of the principal parts of certain of the equipment in another example of the present invention.

In order to heat up the intermediate transfer medium 5 and the toner of a toner image, it may permitted that, as shown in FIG. 3, said heat roller 7 is replaced by simple roller 12 with which a heat roller 13 having a heater 13A is brought into revolving contact. It is preferable that the surface layer of said heat roller 13 is composed of Teflon or silicone rubber to have the surface releasability. In this case, it is desirable to make a wider contact area of roller 12 with heat roller 13.

Figure 5:
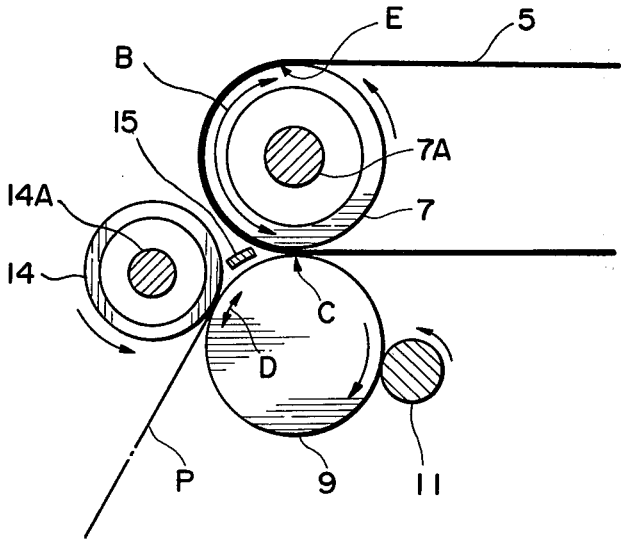
FIG. 5 is an enlarged diagram illustrating a portion of the example in FIG. 4.
Figure 4:
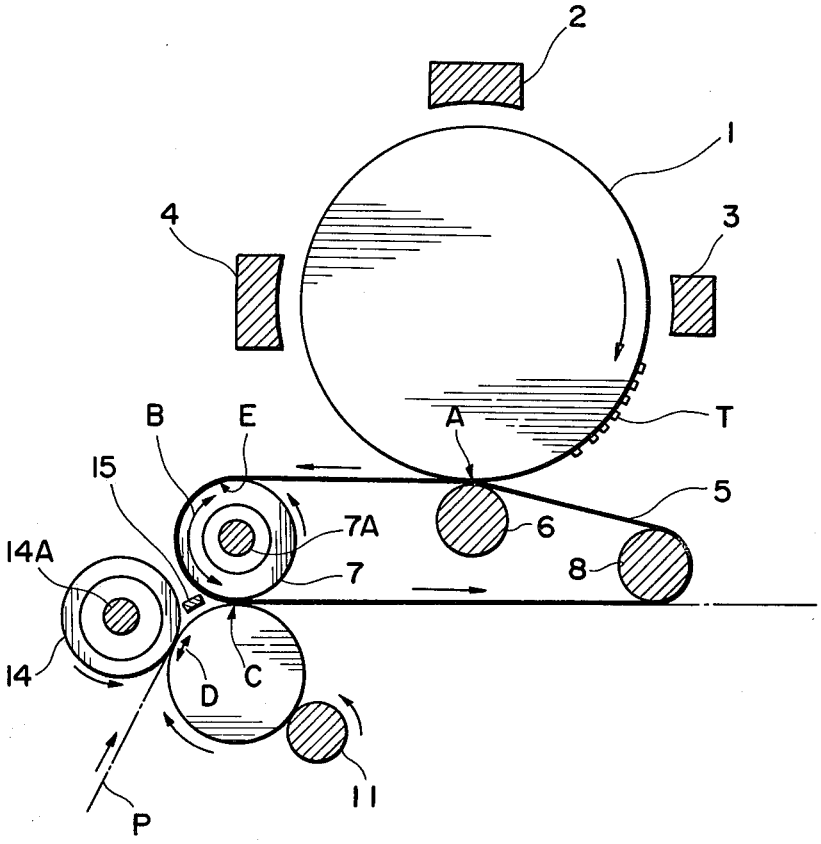
FIG. 4 is an illustrative diagram showing the means of a further example constituting the present invention.

FIG. 4 illustrates another example of the present invention, wherein a heating roller 14 having a heater 14A is provided in place of transfer material heating plate 10 of the example shown in FIG. 1, to be opposed to pressure contact roller 9, and a transfer material guide plate 15 is further provided. As shown in FIG. 5, the transfer material is heated up by means of the heating roller 14 at the time when said transfer material is passed through the transfer material heating area D comprising the pressure interposing section between the heating roller 14 and the pressure contact roller 9, and then reaches the transferring and fixing area C along transfer material guide plate 15, and thereafter a toner image on intermediate transfer medium 5 is thus transferred and fixed onto the transfer material, similar to the case of the example shown in FIG. 1. Said transfer material heating roller 14 irradiates the heat to the transfer material in an instant, being different from the example shown in FIG. 1. On the surface of said heating roller 14, it is preferable to apply either the coating process of a fluorine resin such as polytetrafluoroethylene, perflouroalkoxy resin or polyfluoroethylene-propylen, or the Tufram process in order to endow it with the surface releasability so as not to adhere to the toner and the like, or one may place the same in juxtaposition to a felt or a blade in order to remove the adhered toner.

Figure 6:
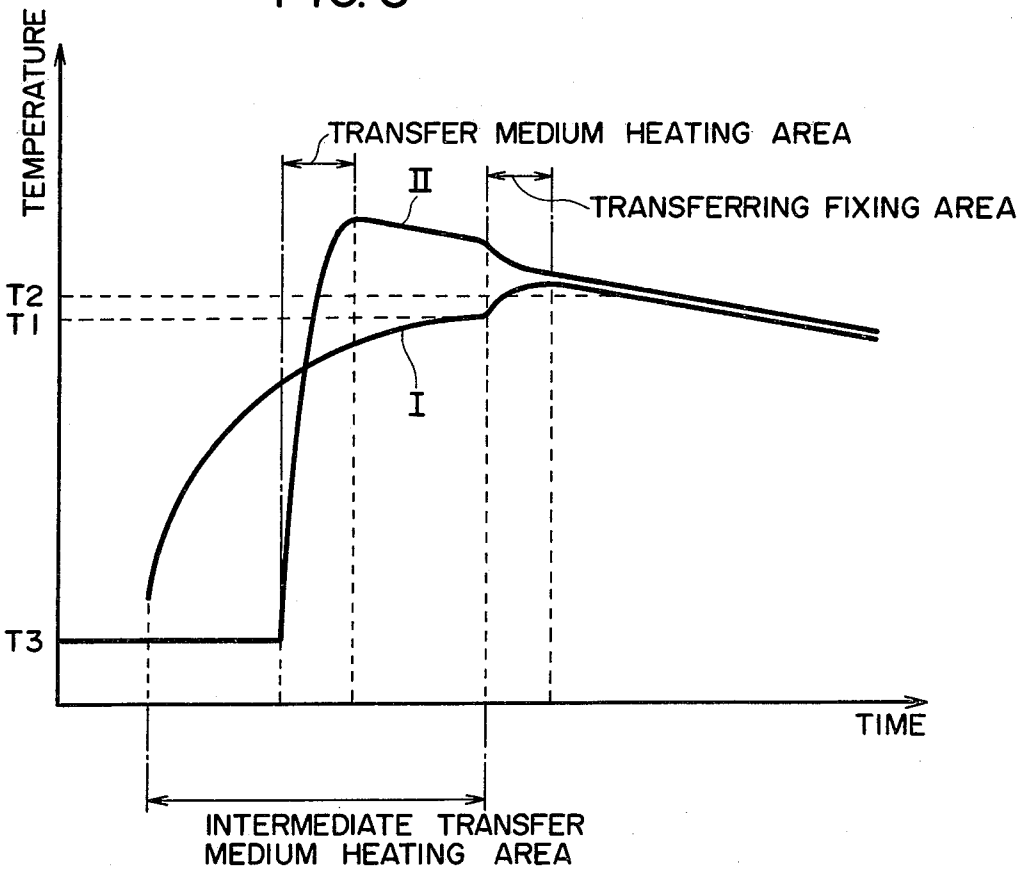
FIG. 6 is a graph of the curves indicating the temperature changes of both of the intermediate transfer medium carrying a toner image and a transfer material in the example in FIG. 4.

FIG. 6 is a graph indicating the temperature changes of a toner image surface and the surface of intermediate transfer medium 5 having the toner image and also the surface of a transfer material coming into contact with intermediate transfer medium 5, both in an example of the means shown in FIG. 4, wherein curve IA represents the temperature changes of the former, while curve IIA represents the temperature changes of the latter, respectively. From the curves observed, similar to the case in FIG. 1, it is obvious that both of the temperature changes are not much during the progress of the movements to transferring and fixing area C.

Figure 7:
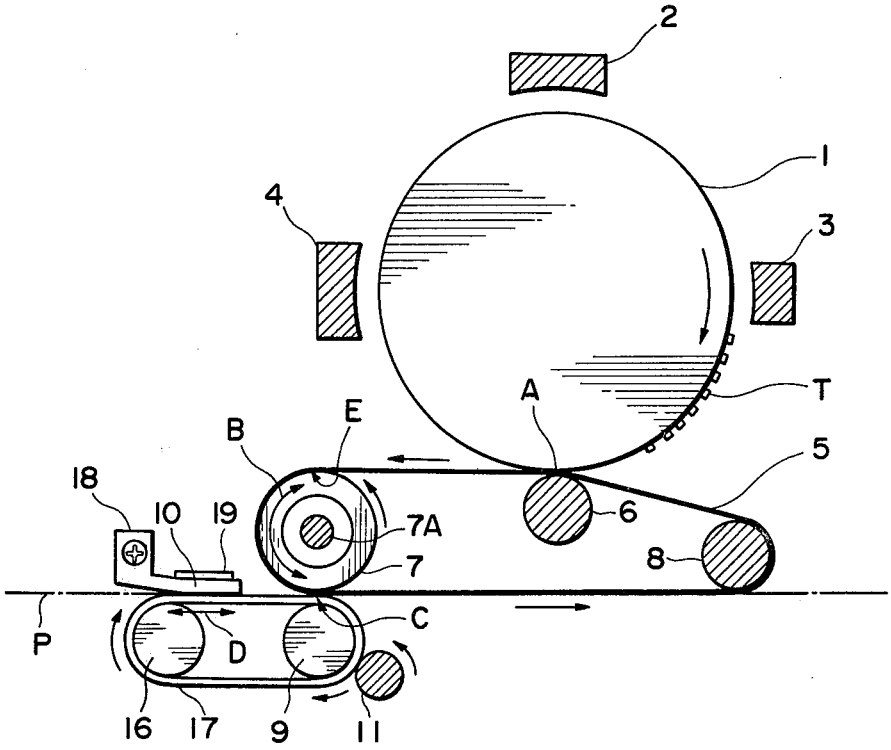
FIG. 7 and FIG. 8 are illustrative diagrams of the constitution of equipment embodying still further examples of the present invention.

FIG. 7 shows a further example of the present invention, wherein endless belt 17 is suspended above a pressure contact roller 9 and a tension roller 16 and the straight forwarding section of said endless belt 17 is positioned along the transfer material passage P; at the same time transfer material heating plate 10 is provided opposite to the endless belt 17, and said transfer material heating plate 10 is pivotally supported so as to be freely rotatable in a support 18. Numeral 19 indicates a heater. According to such an arrangement as above, it is possible to freely increase the period of time to bring transfer material heating plate 10 into contact with the transfer material and also possible to surely heat up the transfer material while moving the transfer material at a high speed. Furthermore, the transfer material is positively conveyed, so that a greater reliability thereof can be obtained, and also, the configuration of the transfer material heating plate 10 may be of a flat one, so that the manufacture thereof is exemplified.

It is preferable that the materials of said endless belt 17 are heat-resisting elastic substance such as silicone rubber, polyimide and polyimideamide of which the thickness varies according to the materials, for example, the thickness thereof is preferably 0.1–5 mm, inter alia, 0.5–3 mm in the case of using a silicone rubber, in particular. It is also preferable that the transfer material heating plate 10 is applied, as has been described already, with a suitable surface treatment so as to reduce the coefficient of friction thereof and with the abrasion resistance as well as the surface releasability. In order to increase the frictional force against endless belt 17, it may be permitted to provide a groove (not shown) on the outer circumferential surfaces of both the pressure contact roller 9 and the tension roller 16 and in this case it is further preferable that the depth of such groove is of the order of 0.1 mm. In addition, the tension roller 16 is preferably composed of a crown-roller of which the outer diameter of the central section thereof is made larger than the outer diameter of the both ends thereof, in order to prevent endless belt 17 from skewing.

Figure 8:
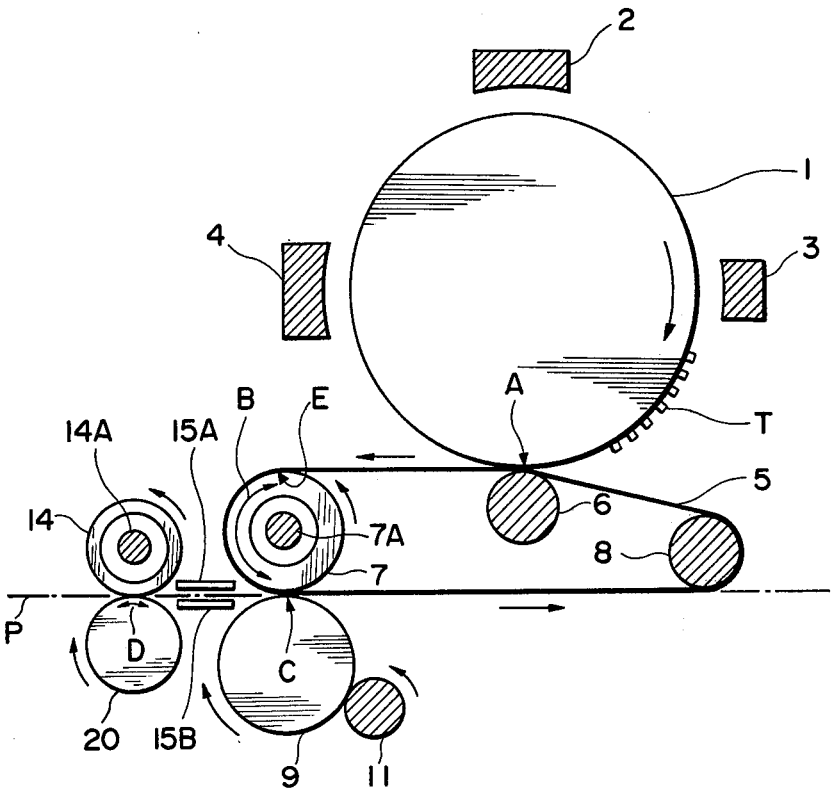

FIG. 8 shows a still further example of the present invention, in which on the side the transferring and fixing area C in the transfer material moving passage P, the example includes a heating roller 14 and a roller 20 both contacting transfer material between them, in addition to pressure contact roller 9. According to this arrangement, the transfer material is heated up independently of pressure contact roller 9, so that the latter need not be heated, and roller 20 functions merely to bring a transfer material into pressure contact with the heating roller 14; therefore, it is possible to realize the improvement of heating efficiency of the heating roller 14 and in the accuracy in controlling the heating temperatures of the transfer material, and consequently it is possible to prevent an offset phenomenon caused by an excessive heating from occurring. In addition to the above, the transfer material is heated at a position apart from pressure contact roller 9, so that the toner is prevented from adhering to the transfer material from pressure contact roller 9 by the heat. Numerals 15A and 15B indicate the transfer material guide plate.

In the description of the examples of the invention as above, however, one may also incorporate a heater (not shown) to pressure contact roller 9, and when incorporated therein it is possible to lower the temperatures for heating both the heat roller 7 for heating the intermediate transfer medium 5 and the toner and the transfer material heating plate 10 or the heating roller 14 for heating the transfer material, and also possible to surely and completely remove the toner which may have adhered to said pressure contact roller 9 through cleaning roller 11. Furthermore in the case that said pressure contact roller 9 is heated up to a temperature at which the toner can be deformed, it is possible to satisfactorily transfer and fix the toner without occurring any offset phenomenon, also when both of the temperatures of the toner and intermediate transfer medium 5 immediately before entering transferring and fixing area C (i.e., the temperature of heat roller 7) and the temperature for heating a transfer material, may be set at such a temperature as not to cause any deformation of the toner, provided that pressure contact roller 9 is not heated as much.

In accordance with the present invention as described above, the toner image on intermediate transfer medium 5 may be transferred and fixed surely and excellently onto a transfer material as the resolution thereof is being maintained as high as it is, and further the toner on toner image carrier 1 are transferred onto intermediate transfer medium 5 by being applied with pressure thereto, therefore a latent image on the toner image carrier 1 is never fundamentally destroyed, so that it is possible to form the identical and sharp toner image through the development of said latent image again and, consequently, to surely realize the retention system.

What is claimed is:

1. In the method of transferring a toner image on a toner image carrier onto a transfer medium by bringing the former into pressure contact with the latter, and subsequently applying said transferred image onto transfer material over a transferring fixing contact area, the improvement comprising the steps of heating the transfer medium bearing the toner image to a temperature at which the toner remains in a nonfluid condition immediately prior to said transferring fixing contact area, heating said transfer material to a temperature substantially greater than the melting temperature of the toner immediately prior to said transferring fixing contact area, and bringing said super-heated transfer material into pressure contact with the under-heated transfer medium throughout said transferring fixing contact area, whereby the super-heated transfer material raises the temperature of the under-heated transfer medium to a temperature sufficient to effect transfer of the toner image from the transfer medium to the transfer material.

2. The method according to claim 1, in which heat is applied to the transfer medium by a heat roller about which said transfer medium extends, and heat is applied to the transfer material by a heating plate pressing said transfer material against a pressure roller cooperating with said heat roller to form said transferring fixing contact area to effect transferring and fixing of the toner image upon said transfer material.

3. The method according to claim 1, in which said transfer medium extends about a roller in contact with a pressure roller and heat is applied to said transfer medium by a heat roller pressing said transfer medium against said first-named roller, and in which heat is applied to said transfer material by a heat plate pressing said transfer material against said pressure roller.

4. The method according to claim 1, in which heat is applied to the transfer medium by a heat roller about which said transfer medium extends, and heat is applied to the transfer material by a heat roller pressing said transfer material against a pressure roller cooperating with said heat roller to form said transferring fixing contact area to effect transferring and fixing of the toner image upon said transfer material.

* * * * *